US008425754B2

(12) United States Patent
Oldani et al.

(10) Patent No.: US 8,425,754 B2
(45) Date of Patent: Apr. 23, 2013

(54) CATHODE FOR ELECTROLYSIS CELL

(75) Inventors: Dario Oldani, Milan (IT); Salvatore Peragine, Giovanni (IT); Luciano Iacopetti, Milan (IT)

(73) Assignee: Industrie de Nora S.p.A., Milan (IT)

( * ) Notice: Subject to any disclaimer, the term of this patent is extended or adjusted under 35 U.S.C. 154(b) by 600 days.

(21) Appl. No.: 12/647,727

(22) Filed: Dec. 28, 2009

(65) Prior Publication Data

US 2010/0096275 A1 Apr. 22, 2010

Related U.S. Application Data

(63) Continuation of application No. PCT/EP2008/058276, filed on Jun. 27, 2008.

(30) Foreign Application Priority Data

Jun. 28, 2007 (IT) ..... MI07A001288

(51) Int. Cl.

| | |
|---|---|
| ***C25B 11/03*** | (2006.01) |
| ***C25B 1/26*** | (2006.01) |
| ***C25B 1/02*** | (2006.01) |
| *C25B 11/02* | (2006.01) |

(52) U.S. Cl.

USPC ..... 205/556; 204/280; 204/284

(58) Field of Classification Search ..... 204/279, 204/280, 283, 284; 205/556

See application file for complete search history.

(56) References Cited

U.S. PATENT DOCUMENTS

| | | | |
|---|---|---|---|
| 3,871,988 | A | 3/1975 | Harke et al. |
| 4,017,376 | A | 4/1977 | Mose et al. |
| 4,049,495 | A | 9/1977 | Endo et al. |

FOREIGN PATENT DOCUMENTS

| | | | |
|---|---|---|---|
| WO | WO 2004007803 | A1 * | 1/2004 |
| WO | WO 2006120002 | A1 * | 11/2006 |

OTHER PUBLICATIONS

International Search Report for Application No. PCT/EP2008/058276 dated Nov. 20, 2008. 4 pages.

* cited by examiner

*Primary Examiner* — Keith Hendricks
*Assistant Examiner* — Steven A. Friday
(74) *Attorney, Agent, or Firm* — Lucas & Mercanti, LLP

(57) ABSTRACT

The invention relates to a cathode for diaphragm chlor-alkali cells delimited by a conductive foraminous surface and having an internal volume containing two juxtaposed elements aimed at improving the fluid and electrical current distribution.

10 Claims, 6 Drawing Sheets

CATHODE FOR ELECTROLYSIS CELL

CROSS REFERENCE TO RELATED APPLICATIONS

This application is a continuation of PCT/EP2008/058276 filed Jun. 27, 2008, that claims the benefit of the priority date of Italian Patent Application No. MI2007A001288 filed Jun. 28, 2007, the contents of which are herein incorporated by reference in their entirety.

FIELD

The invention relates to a cathode for electrolysis cells, particularly suitable for use in diaphragm chlor-alkali electrolysis cells.

BACKGROUND OF THE INVENTION

The production of chlorine by electrolysis of alkali chloride solutions, in particular of sodium chloride brine, is still by far the electrochemical process of highest industrial relevance. As it is well known, different kinds of electrolysis cells are used for this purpose, one of which provides the use of a separator consisting of a semipermeable porous diaphragm, which is nowadays made of a polymer material hydrophilised with inorganic additives.

A description of the functioning of diaphragm chlor-alkali cells is given in Ullmann's Encyclopaedia of Chemical Technology, 5° Ed., Vol. A6, page 424-437, VCH, while an embodiment of cell internal structure is illustrated in the prior art.

Diaphragm cells of the prior art usually comprise rows of intercalated cathodes and anodes, the cathodes being delimited by a conductive surface provided with openings, for instance a mesh or a punched sheet, shaped as a flattened rectangular prism (according to the so-called "cathode finger" geometry) and welded to a peripheral chamber where connections for feeding and discharging the process fluids are arranged. The diaphragm is deposited on the conductive surface of cathodes by vacuum filtering of an aqueous suspension of its constituents. The anodes intercalated to the cathode fingers may be in contact therewith or spaced by a few millimetres. It is, however, necessary to prevent fingers from being subject to flexures in order to avoid damaging the diaphragm by abrasion. Furthermore, during operation the current must be transmitted as uniformly as possible to the whole cathode surface. A non-uniform distribution would lead in fact to a cell voltage increase and to a lessening of the caustic soda generation efficiency, with simultaneous increase of the oxygen content in chlorine. It follows the need of imparting sufficient stiffness and electrical conductivity to the cathodes.

This problem has been addressed, for example, in the prior arty by equipping the cathodes with a longitudinally corrugated carbon steel or copper internal plate. The external conductive surface is secured, preferably by welding, to the apexes of the plate corrugations solving the problems of homogeneous current distribution and of stiffening. Nevertheless, the longitudinal corrugations turn out to be an obstacle to the free motion of hydrogen bubbles, which cannot rise vertically and end up accumulating along the upper generatrix of the fingers, subsequently exiting the peripheral chamber through the relevant outlet. The longitudinally corrugated plate collects hydrogen under each one of the corrugations making it flow therealong longitudinally until discharging through suitable openings in the peripheral chamber: since such flow is difficult to equalise, it follows that the amount of hydrogen present under each corrugation is variable, occluding the facing diaphragm region to a different extent, which leads to a poor current distribution. There has also been described corrugated internal plates, in which corrugations are vertically arranged. Hydrogen can thus be freely collected in the upper part of the fingers, but its flow toward the peripheral chamber is hindered by the upper portion of the corrugations. Moreover, the stiffening effect of vertical corrugations turns out to be unsatisfactory.

More advanced solutions have been proposed in WO 2004/007803 and WO 2006/120002, incorporated herein in their entirety and disclosing the use of plates inserted in the internal volume of the cathode, having discrete protrusions such as bumps, caps or tiles, arranged so as to favour the free circulation of product hydrogen both longitudinally and vertically while attaining an electrical connection with well distributed resistive paths, besides imparting an optimal stiffening to the structure.

The solutions proposed in the prior art are, nevertheless, still unsatisfactory under two standpoints:

- under a first aspect, for large-sized cathodes at the most common process current densities (2.5 to 3 kA/m$^2$) the use of internal plates of a highly conductive material such as copper would be preferable in order to improve the current distribution to a sufficient extent. On the other hand, the need to sufficiently stiffen the structure would require copper plates of such a high thickness that this would have a negative impact in terms of costs. It is therefore preferred to manufacture the internal plates out of a material of better mechanical characteristics and/or lower cost, such as carbon steel or different iron or nickel-based materials. The electrical conductivities of steel or nickel are, however, not optimal for big sized cells.
- under a second aspect, the internal plate geometries proposed in the cited documents guarantee a good circulation of hydrogen but not a sufficient mixing of the electrolyte inside the cathode. The cathode internal volume is in fact partially occupied by a liquid mixture of process electrolyte and caustic product, whose level normally exceeds half of the cathode height. In such a rather dense phase, concentration and temperature gradients tend to be established, counteracted only in part by natural convection and liable to decrease current efficiency and increase energy consumption and oxygen content in product chlorine.

It would, therefore, be desirable to have a cathode for electrolysis cells overcoming the limitations of the prior art, particularly as regards current distribution and mixing of the electrolyte inside the internal volume.

In another aspect, it would be desirable to have a diaphragm electrolytic cell overcoming the limitations of the prior art in terms of energy consumption or quality of product chlorine.

SUMMARY OF THE INVENTION

In one embodiment, the invention is direct to a cathode for an electrolysis cell having an internal volume delimited by a foraminous conductive surface comprising two major faces suitable for being coated with a chemically inert porous diaphragm, said internal volume comprising at least an upper element and a lower element for distributing the fluids and the electric current, each of said distributing elements comprising one plate of a first conductive material equipped on both faces with a multiplicity of bumps in electrical contact with both of said major faces of said conductive surface and one foot of a second conductive material, said foot of said upper element disposed in the bottom part and in electrical contact with one major face of said conductive surface, said foot of said lower element disposed in the top part, in electrical contact with the opposed major face of said conductive surface and provided with a multiplicity of protrusions delimiting grooves for the passage of fluids, said feet of said upper and lower element facing each other at least partially.

In a further embodiment, the invention is directed to a process of chlor-alkali electrolysis comprising feeding a solution of alkali chlorides to the anodic compartment of a cell comprising at least one cathode having an internal volume delimited by a foraminous conductive surface comprising two major faces suitable for being coated with a chemically inert porous diaphragm, the internal volume comprising at least an upper element and a lower element for distributing the fluids and the electric current, each of said distributing elements comprising one plate of a first conductive material equipped on both faces with a multiplicity of bumps in electrical contact with both of the major faces of the conductive surface and one foot of a second conductive material, the foot of the upper element disposed in the bottom part and in electrical contact with one major face of the conductive surface, the foot of the lower element disposed in the top part, in electrical contact with the opposed major face of the conductive surface and provided with a multiplicity of protrusions delimiting grooves for the passage of fluids, the feet of the upper and lower element facing each other at least partially, and applying an electric current and discharging a hydrogen gas flow and a solution of caustic product and exhaust alkali chloride generated in the internal volume of said at least one cathode.

DESCRIPTION

Figure 1:
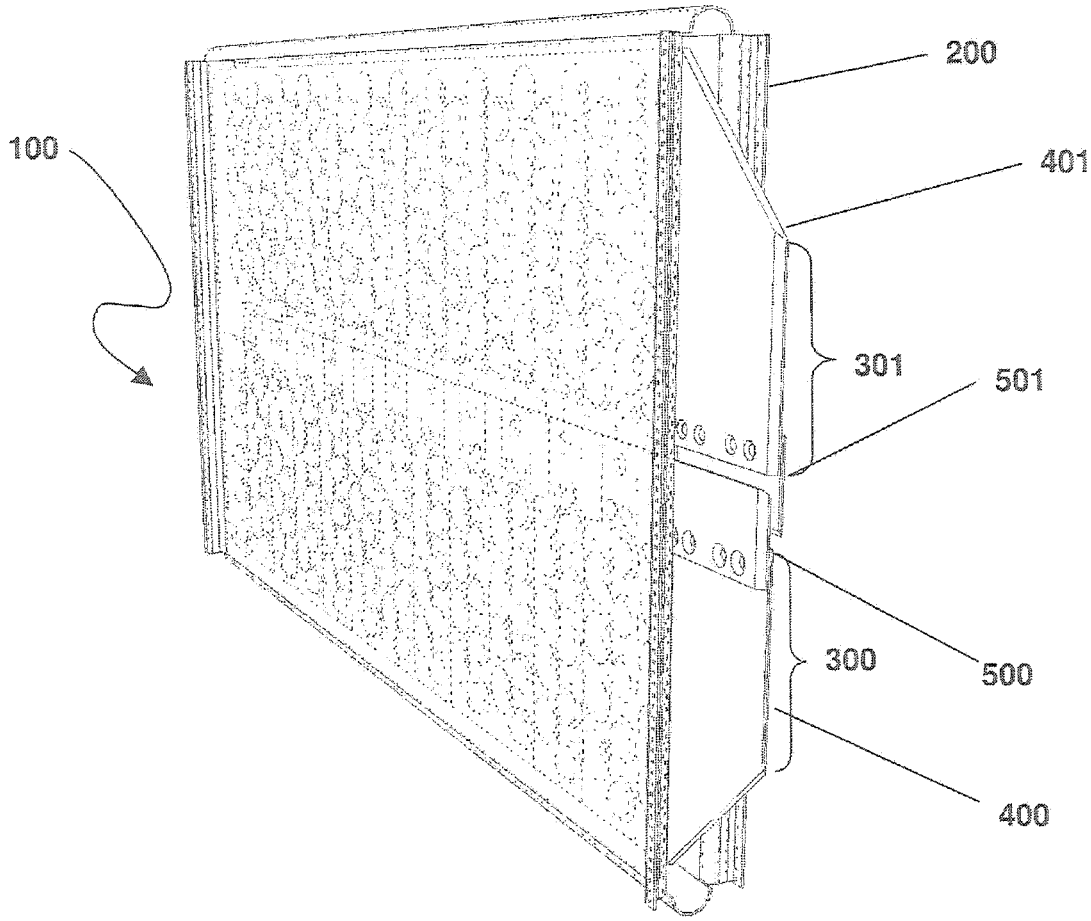
FIG. 1 illustrates a cathode according to an embodiment of the invention.

In the following description, for purposes of explanation, numerous specific details are set forth in order to provide a thorough understanding of the claimed subject matter. It may be evident, however, that the claimed subject matter may be practiced without these specific details.

One or more implementations of the invention are hereinafter described. However, it will be appreciated by those skilled in the art that the invention is not limited to the exemplary implementations illustrated and described hereinafter.

Various aspects of the invention are set out in the accompanying claims.

In one embodiment, the cathode has a flattened rectangular shape and has an internal volume delimited by a foraminous conductive surface (cathodic surface) whose major faces are covered with a chemically inert porous diaphragm. The internal volume contains at least two elements, namely an upper element and a lower element, favouring the electrical current and fluid distribution, each comprising a plate of a first conductive material, for instance carbon steel, provided on both faces with a multiplicity of discrete protrusions or bumps in electrical contact with both major faces of the cathodic surface, and a foot of a second conductive material, for instance copper, secured to one face only of the cathodic surface. The two elements are assembled so that the foot of the upper element is disposed in the bottom part and secured to one face of the cathodic surface, and the foot of the lower element is disposed in the top part and secured to the opposed face of the cathodic surface, arranged so as to face the upper element foot at least partially. In one embodiment, the foot of the lower element is further provided with a multiplicity of groove-shaped protrusions allowing the passage of fluids. In one embodiment, also the foot of the upper element is provided with groove-shaped protrusions. This can provide the advantage of manufacturing the two elements according to the same design, which simplifies the construction. In one embodiment, the longitudinal edge of the foot has a blunt profile. This feature can improve the passage of fluid, providing a draft for the process electrolyte. In one embodiment, three or more distributing elements can be arranged likewise, for instance with the intermediate elements provided with one lower and one upper foot, in accordance with the same basic concept.

In one embodiment, the two parts composing the distributing elements, namely the plate and the foot, are mutually secured by means of welds made across matching holes on the two pieces. This feature can facilitate the execution of the welding—especially when the troublesome coupling of a copper foot with a steel plate must be accomplished—through the partial extrusion of one material into the other (for instance of copper into steel). Holes arranged for this purpose may also act as an additional element for recirculation of the electrolyte within the cathode.

The discrete protrusions of the plate, referred to as bumps in the following, allow the free circulation of hydrogen, their shape has no other limitation, and they can be designed for instance as spherical, elliptical, pyramidal, prismatic or cylindrical caps and obtained by deformation of the plate with a mould or by welding or other type of fixing of discrete elements to a planar plate. Bumps may also consist of elongated main protrusions whose short side is open to the passage of fluids and whose surface is equipped with a series of minor protrusions.

The distributing elements as described combine the mechanical properties of the steel plate with the electrical properties of the copper foot. The latter can be of relatively reduced size and still be capable of transmitting the electric current in an optimal fashion along the cathodic surface. The mutual arrangement of copper feet partially facing each other and the grooved protrusions can increase the electrolyte mixing to a surprising extent by creating multiple paths for the descending degassed liquid, as illustrated in the attached drawings.

FIG. 1 illustrates an embodiment of a cathode (100), delimited by a foraminous conductive surface (200) of flattened rectangular shape, optionally made of steel or nickel, whereon the diaphragm is subsequently deposited. In the cathode internal volume there are arranged a lower element (300) and an upper element (301) for distributing the fluids and the electric current. The lower element (300) is obtained by coupling a plate (400) provided with bumps, optionally made of carbon steel, with a foot (500), optionally made of copper. Likewise, the upper element (301) is obtained by coupling a plate (401) provided with bumps and a foot (501). In one embodiment, the two lower (300) and upper (301) elements are identical, for the sake of constructive simplicity. In such case, plates (400) and (401) and feet (500) and (501) are identical one another.

Figure 2:
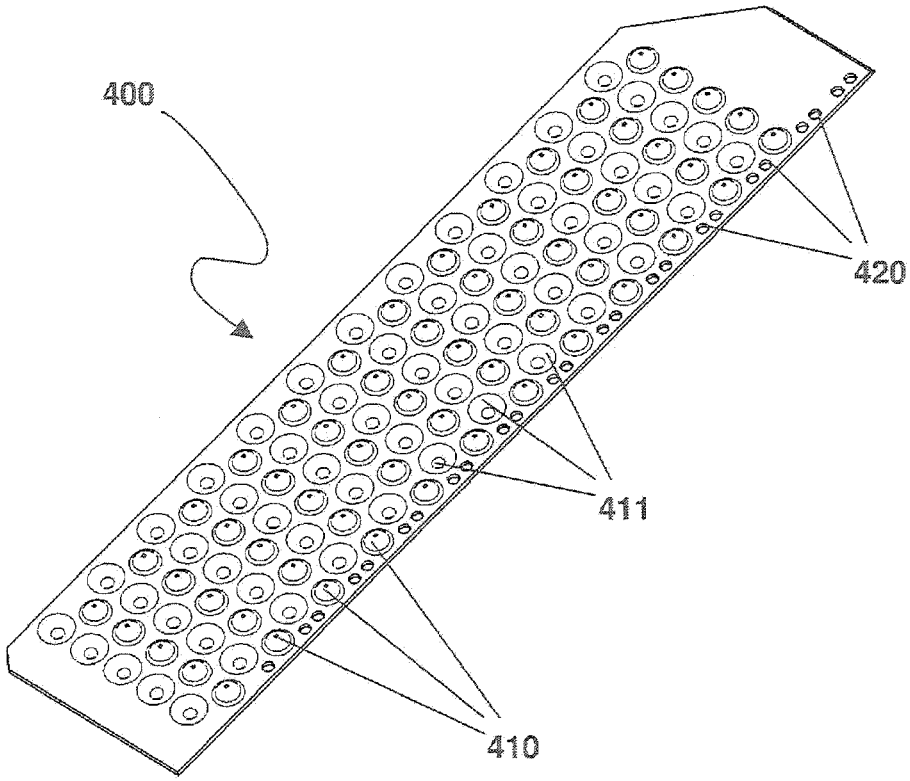
FIG. 2 illustrates a component of the cathode of FIG. 1 comprising a plate equipped with discrete protrusions.

FIG. 2 illustrates an embodiment of plate (400) of lower element (300), obtained by deformation of a planar sheet so as to form a series of spherical cap-shaped bumps (410) protruding on the opposed face. Plate (400) is also provided with a series of holes (420) along the lower side that can be used for the coupling with the relevant foot (500), shown in FIG. 1.

Figure 3:
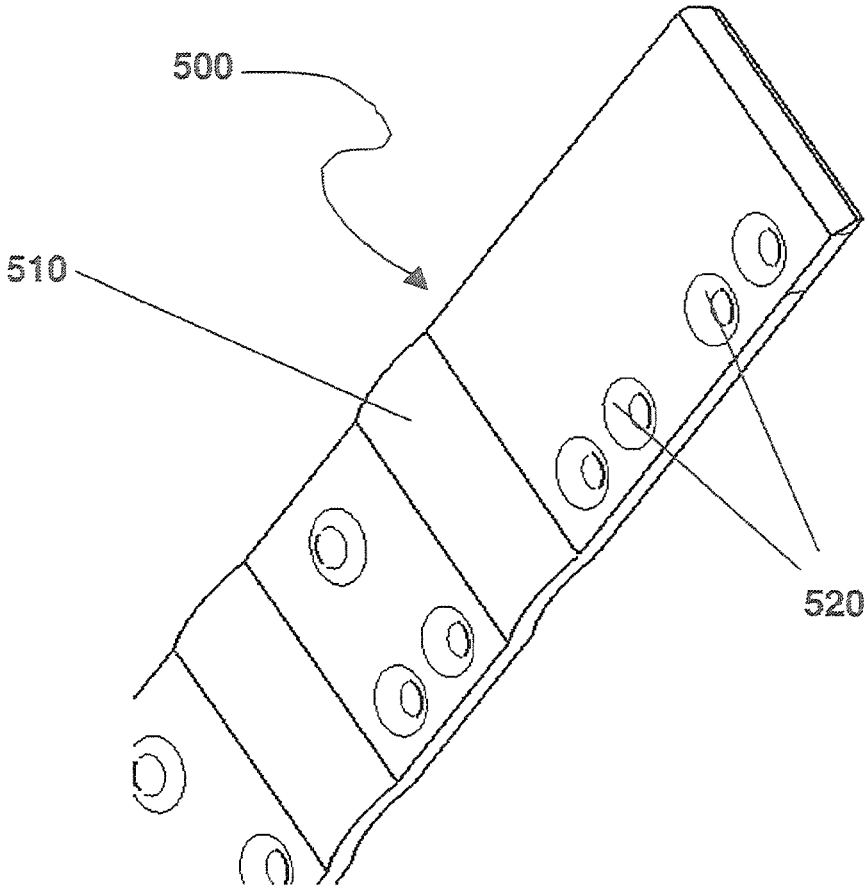
FIG. 3 illustrates a component of the cathode of FIG. 1 comprising a foot suited to form, in cooperation with the plate of FIG. 2, a distributing element according to one embodiment.

FIG. 3 illustrates an embodiment of foot (500) of lower element (300), obtained from a sheet strip, optionally of copper. The short side of the sheet strip is crossed by a series of protrusions (510) which upon assembling the cell are arranged vertically and delimit a series of grooves for the passage of fluids, in particular of the degassed electrolyte, running downwards therealong. Foot (500) is also provided with a series of holes (520) that can be used for the coupling with the relevant plate (400), shown in FIGS. 1 and 2. In one embodiment, foot (501) of upper element (301), shown in FIG. 1, may be manufactured in the same way.

Figure 4:
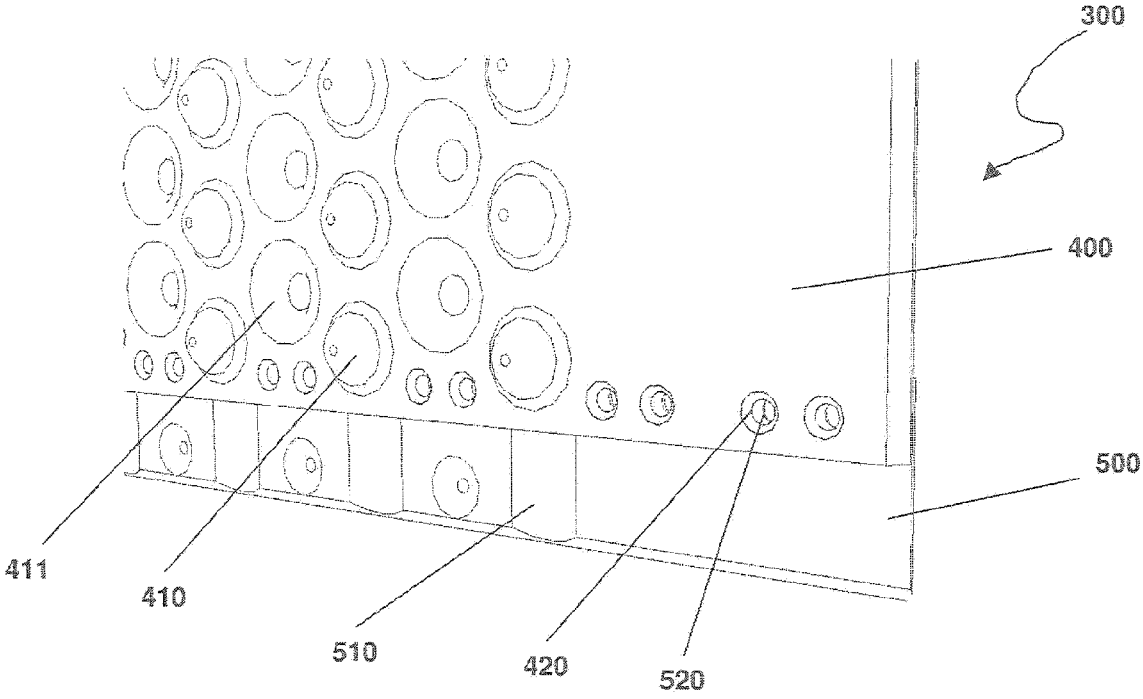
FIG. 4 illustrates an embodiment of the coupling of the plate of FIG. 2 with the foot of FIG. 3.

FIG. 4 illustrates a detail of lower element (300) illustrating the coupling of plate (400) provided with bumps (410, 411) and foot (500). Elements illustrated in the preceding figures are indicated with the same reference numerals. It can be seen how in this embodiment, holes (420) of plate (400) are disposed in a row matching exactly a similar row of holes (520) of foot (500). In such holes may be made the welds securing foot (500) to plate (400), optionally by extruding part of the material of foot (500) into the relevant hole of plate (420). The clearance left after coupling holes (420) and (520) can be used for the internal circulation of the electrolyte, in addition to the grooves delimited by protrusions (510).

Figure 5:
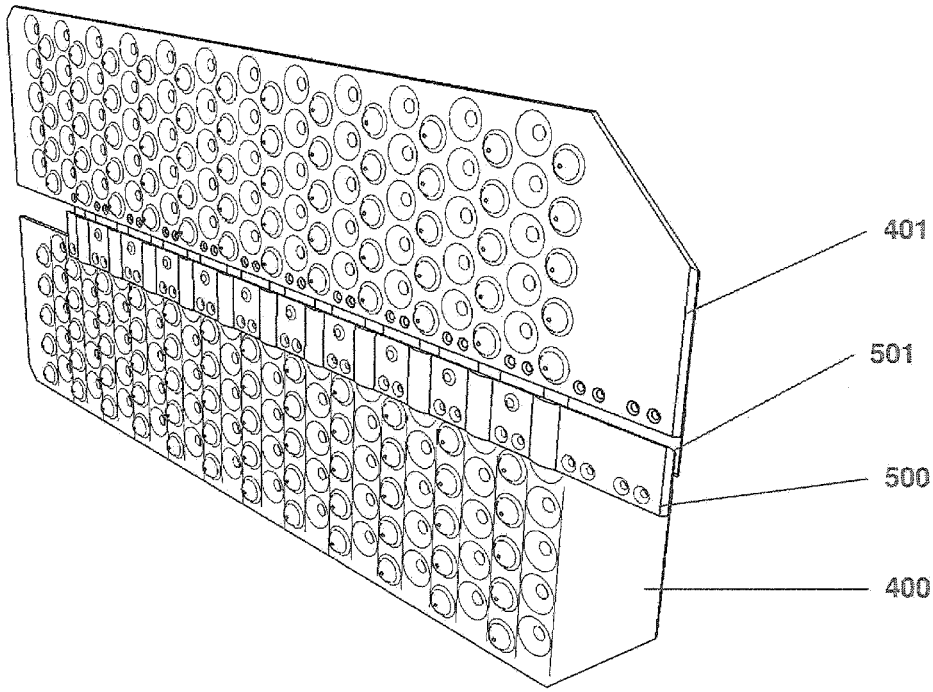
FIG. 5 illustrates the arrangement of two distributing elements according to one embodiment.

FIG. 5 illustrates an arrangement of the two distributing elements according to one embodiment of the invention. Foot (500) of the lower element is disposed in the top part of the respective plate (400), and foot (501) of the upper element is disposed in the bottom part of the respective plate (401). Moreover, feet (500) and (501) of the two distributing elements are arranged in parallel and partially facing each other in order to create a recirculation path for the electrolyte, as is better evidenced in FIG. 6.

Figure 6:
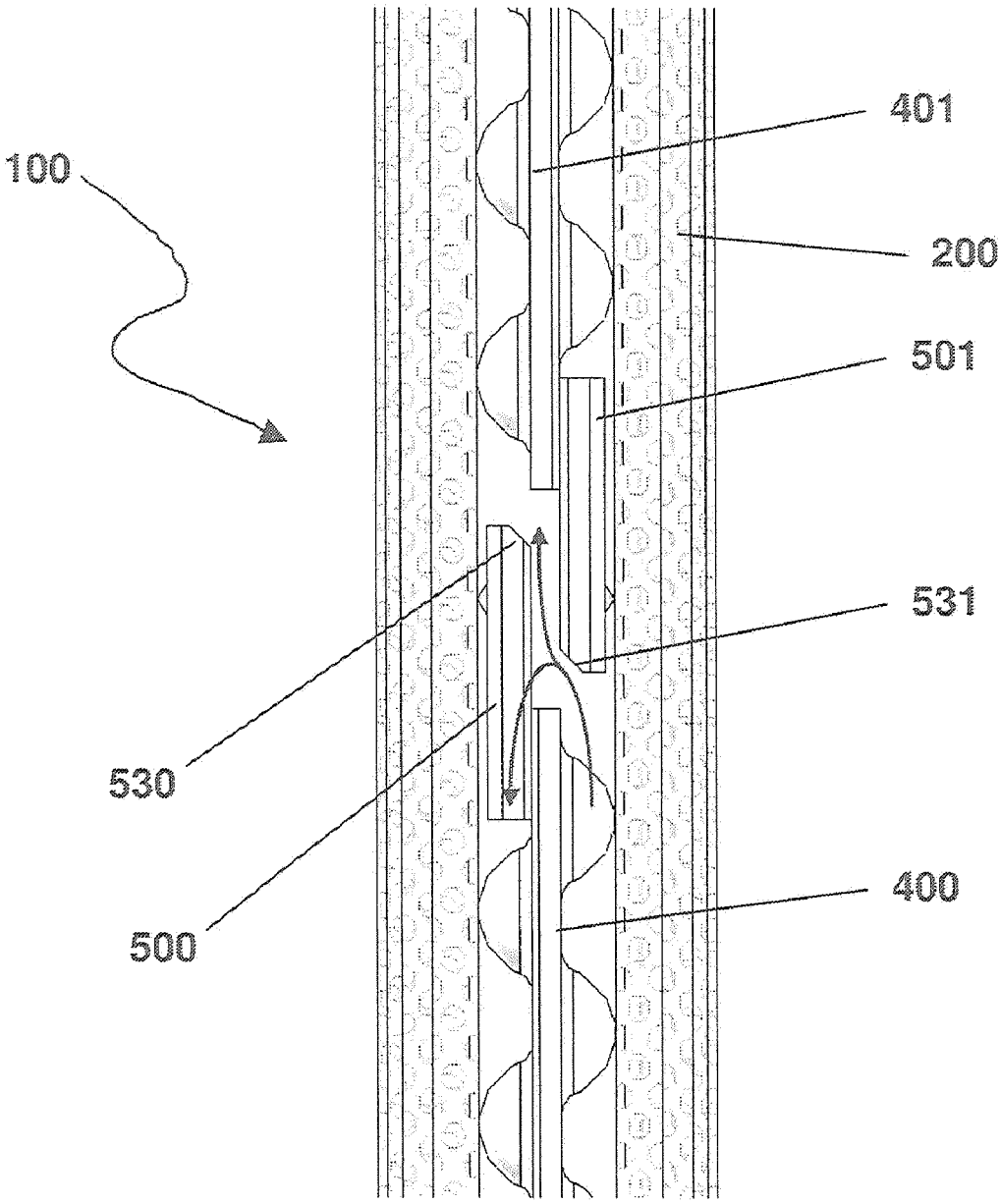
FIG. 6 illustrates a detail of a lateral section of the cathode of FIG. 1 containing two distributing elements arranged as in FIG. 5.

FIG. 6 illustrates a lateral section of a detail of cathode (100). As can be seen in the drawing, plates (400) and (401) contact both faces of cathodic surface (200), while the two feet (500) and (501) contact opposite faces. The partial overlapping of feet (500) and (501), both of which are below the liquid level during operation, delimits a region which can favour the electrolyte convective motion, having an upward component of hydrogen-richer electrolyte and a downward component of mostly degassed electrolyte. The upward component of the electrolyte flow overtakes edge (531) of foot (501) of the upper distributing element, which is shown in the Figure with a blunt profile. The blunted edge can act as a draft for the electrolyte flow, which proceeds in its upward motion and which can also take advantage of the optional grooves present on the surface of foot (501). The downward component of the electrolyte flow, taking advantage of grooves delimited by protrusions (510) and of the clearance left after coupling holes (420) and (520) shown in FIG. 4, crosses the internal volume of cathode (100) downwards in a substantially facilitated manner, as indicated by the arrows.

The invention will be better understood by aid of the following examples, which shall not be intended as a limitation of the scope thereof.

EXAMPLE

Two diaphragm chlor-alkali cells of industrial size suitable for being fed with a 300 g/l sodium chloride brine and operated at a current density of 2.5 kA/m$^2$ were assembled. The cells included a cathode body comprising fingers made of carbon steel punched sheets whereon a porous polymer diaphragm added with zirconium oxide particles was deposited. One cell was equipped with internal plates provided with spherical cap-shaped bumps according to the teaching of WO 2004/007803, while the other was equipped with two distributing elements according to the embodiment shown in the attached drawings; each plate was obtained by coupling a carbon steel plate provided with spherical cap-shaped bumps with a copper foot. Both components of the distributing elements has a thickness of 6 millimetres. After a few weeks of operation deemed necessary for stabilising the various components such as the diaphragms, cell voltages, faradic efficiency in terms of caustic soda production and oxygen content in product chlorine were detected, with the following results:

- cell according to WO 2004/007803: average voltage 3.3 V, faradic efficiency 95%, oxygen content in chlorine 2.2%
- cell according to the invention: average voltage 3.2 V, faradic efficiency 97%, oxygen content in chlorine 2.0%.

Although the disclosure has been shown and described with respect to one or more embodiments and/or implementations, equivalent alterations and/or modifications will occur to others skilled in the art based upon a reading and understanding of this specification. The disclosure is intended to include all such modifications and alterations and is limited only by the scope of the following claims. In addition, while a particular feature may have been disclosed with respect to only one of several embodiments and/or implementations, such feature may be combined with one or more other features of the other embodiments and/or implementations as may be desired and/or advantageous for any given or particular application. Furthermore, to the extent that the terms "includes", "having", "has", "with", or variants thereof are used in either the detailed description or the claims, such terms are intended to be inclusive in a manner similar to the term "comprising."

The discussion of documents, acts, materials, devices, articles and the like is included in this specification solely for the purpose of providing a context for the invention. It is not suggested or represented that any or all of these matters formed part of the prior art base or were common general knowledge in the field relevant to the invention before the priority date of each claim of this application.

The invention claimed is:

1. Cathode for electrolysis cell having an internal volume delimited by a foraminous conductive surface comprising two major faces suitable for being coated with a chemically inert porous diaphragm, said internal volume comprising at least an upper element and a lower element for distribution of fluids and electric current, each of said distributing elements comprising one plate of a first conductive material equipped on both faces of the plate with a multiplicity of bumps, the bumps on one face in electrical contact with one of said major faces of said conductive surface, and the bumps on an opposed face in electrical contact with an opposed major face of said conductive surface, and each of said distributing elements comprising one foot of a second conductive material, said foot of said upper element disposed in the bottom part and in electrical contact with one major face of said conductive surface, said foot of said lower element disposed in the top part, in electrical contact with the opposed major surface of said conductive surface and provided with a multiplicity of protrusions delimiting grooves for the passage of fluids, said feet of said upper and lower element facing each other at least partially.

2. The cathode according to claim 1, wherein the foot of the upper element is provided with a multiplicity of protrusions delimiting grooves for the passage of fluids.

3. The cathode according to claim 1, the longitudinal edge of the feet of the upper and lower distributing elements has a blunt profile.

4. The cathode according to claim 1, wherein at least the foot of the lower element is secured to the plate of the lower element equipped with bumps through a series of welds made across matching holes on the foot and the plate of the lower element available for the passage of fluids.

5. The cathode according to claim 1, wherein the first conductive material comprises one or more of iron, nickel and alloys thereof, and the second conductive material comprises copper.

6. The cathode according to claim 1, wherein the bumps are spherical, elliptic, cylindrical, prismatic or pyramidal caps.

7. The cathode according to claim 6, wherein the bumps consist of main elongated protrusions whose short side is open to the passage of fluids and whose surface is equipped with a series of minor protrusions.

8. A cell for chlor-alkali electrolysis comprising at least one cathode of claim 1.

9. Process for chlor-alkali electrolysis comprising:

feeding a solution of alkali chlorides to the anodic compartment of an electrolysis cell comprising at least one cathode having an internal volume delimited by a foraminous conductive surface comprising two major faces suitable for being coated with a chemically inert porous diaphragm, the internal volume comprising at least an upper element and a lower element for distributing the solution and electric current, each of said distributing elements comprising one plate of a first conductive material equipped on both faces of the plate with a multiplicity of bumps, the bumps on one face in electrical contact with one of the major faces of the conductive surface, and the bumps on an opposed face in electrical contact with an opposed major face of said conductive surface, and each of said distributing elements comprising one foot of a second conductive material, the foot of the upper element disposed in the bottom part and in electrical contact with one major face of the conductive surface, the foot of the lower element disposed in the top part, in electrical contact with the opposed major face of the conductive surface and provided with a multiplicity of protrusions delimiting grooves for the passage of fluids, the feet of the upper and lower element facing each other at least partially; and applying an electric current and discharging a hydrogen gas flow and a solution of caustic and exhaust alkali chloride generated in the internal volume of the at least one cathode.

10. Process according to claim 9, wherein the hydrogen gas flow has a free upward motion in the internal volume of said multiplicity of cathode fingers and the solution of caustic product and exhaust alkali chloride is subject to a convective motion inside the internal volume of the at least one cathode having a downward component inside the grooves of the foot of the lower element.

* * * * *